US007244149B1

(12) United States Patent
Wang

(10) Patent No.: US 7,244,149 B1
(45) Date of Patent: Jul. 17, 2007

(54) CONNECTOR STRUCTURE THAT PROVIDES SECURE CONNECTION

(75) Inventor: Ya Mei Wang, Taoyuan (TW)

(73) Assignee: TDI Technology Co., Ltd., Taoyuan County (TW)

( * ) Notice: Subject to any disclaimer, the term of this patent is extended or adjusted under 35 U.S.C. 154(b) by 0 days.

(21) Appl. No.: 11/521,398

(22) Filed: Sep. 15, 2006

(51) Int. Cl.
*H01R 24/00* (2006.01)

(52) U.S. Cl. ..... 439/629; 439/358

(58) Field of Classification Search ..... 439/351–358, 439/377, 629, 607
See application file for complete search history.

(56) References Cited

U.S. PATENT DOCUMENTS 4,341,428 A * 7/1982 Hatch et al. ..... 439/372
4,874,336 A * 10/1989 Marsh ..... 439/607
4,898,546 A * 2/1990 Elco et al. ..... 439/608
5,176,523 A * 1/1993 Lai ..... 439/64
6,991,487 B2 * 1/2006 Wu ..... 439/358
2004/0203290 A1 * 10/2004 Wang et al. ..... 439/608

* cited by examiner

*Primary Examiner*—James R. Harvey
(74) *Attorney, Agent, or Firm*—Rosenberg, Klein & Lee

(57) ABSTRACT

A connector is provided with a male unit having a frontal end that includes an inserting portion having a plurality of troughs and fitting troughs on lateral sides thereof. Each of two clip-on hooks are located inside of a respective fitting trough, and each of the clip-on hooks are formed with a hook portion, an elastic portion, and a pressing portion. A metal partition covers the top of the male unit. A connecting component connects with the insertion portion and includes a female unit, a circuit board, and a plurality of terminals. The female unit has a pair of clip-on openings for respective releasable coupling with the clip-on hooks to fasten the male and female units together.

8 Claims, 7 Drawing Sheets

CONNECTOR STRUCTURE THAT PROVIDES SECURE CONNECTION

FIELD OF THE INVENTION

The invention relates to an improved structure of a connector, and more particularly, it is related to a connector structure that allows a male unit and a connecting component to clip together and stay fastened.

DESCRIPTION OF PRIOR ART

FIG. 7 is a schematic view showing the connector according to the prior art. The connector is composed of a female unit 6 and a metal partition 7, said metal partition 7 covers one of the surfaces and both lateral sides of female unit 6, and is fixed to the opposing surface by a hook. One side of the female unit 6 has an inserting portion 61, and the inserting portion 61 includes a plurality of connecting openings 62, the connecting openings 62 serve the purpose of connecting another connector. However, when the connector is connected to another connector, the connection between them is often not secure enough and subsequently results in loose connections and low electrical connectivity, which brings much inconvenience.

SUMMARY OF THE INVENTION

The main objective of the invention is to propose a male unit for use in connectors, which has a clip-on hook at both ends. In order to solve the problems described above, each of the female units of the connector that corresponds to each clip-on hook is disposed with a fixed opening. By allowing the clip-on hook and the fixed opening to clip together and become fastened, this invention proposes a connector that can secure all of its components. To achieve the aforementioned objective, the invention proposes a connector structure comprising:

a male unit in which the frontal end includes an inserting portion, the top surface near both edges of said inserting portion having a respective concave portion, and the inserting portion having a plurality of troughs that are evenly distanced, both lateral sides of the frontal end in said male unit have their respective fitting troughs; a clip-on space exists between the fitting trough and insertion portion, a pivot-joint opening and a fastening opening are located between each clip-on space and each protruding portion on both sides of said male unit, the pivot-joint opening is interconnected to the fitting trough;

two clip-on hooks, the two clip-on hooks are structurally symmetrical, the frontal section of said clip-on hook is formed into a hook portion, the middle section of said clip-on hook having a through-hole that leads to the pivot-joint opening mentioned before, the rear section of said clip-on hook is bent into an elastic portion, and the other side of said elastic portion is disposed with a pressing portion for pressing;

a metal partition covers on the top surface of said male unit, wherein its two ends have a respective lateral board, each of said lateral board holds to the surface of the two ends of said male unit, the surface near each of said lateral board is disposed with a pivot and a fastening pin, wherein said fastening pin fits into said fastening opening, and the pivot fits through the pivot-joint opening of said male unit and the through hole of said clip-on hook, it is fitted into said pivot-joint opening;

a connecting component being interconnected to said insertion portion, the connecting component including a female unit and a circuit board, a metal board with pins at both ends surrounds the perimeter of said female unit, and the two ends of said female unit being formed into clip-on portions that allow each said fitting trough to clip onto, the inner wall of each said clip-on portion including a clip-on opening that allows the hook portion of each said clip-on hook to clip and fasten, the section between the two clip-on portions of said female unit having a plurality of terminals, each terminal being evenly distanced from the metal board that surrounds the perimeter of said female unit, each primary terminal of said terminal connected into said troughs independently, and the secondary terminals that face away from the troughs are electrically connected to the circuits on the circuit board.

DETAILED DESCRIPTION OF PREFERRED EMBODIMENT

Please refer to FIGS. 1 to 6, the embodiments of the invention illustrated in these figures are merely optional and only serve the purpose of elucidation, this disclosure is not limited by any of the embodiments provided in this case.

Figure 1:
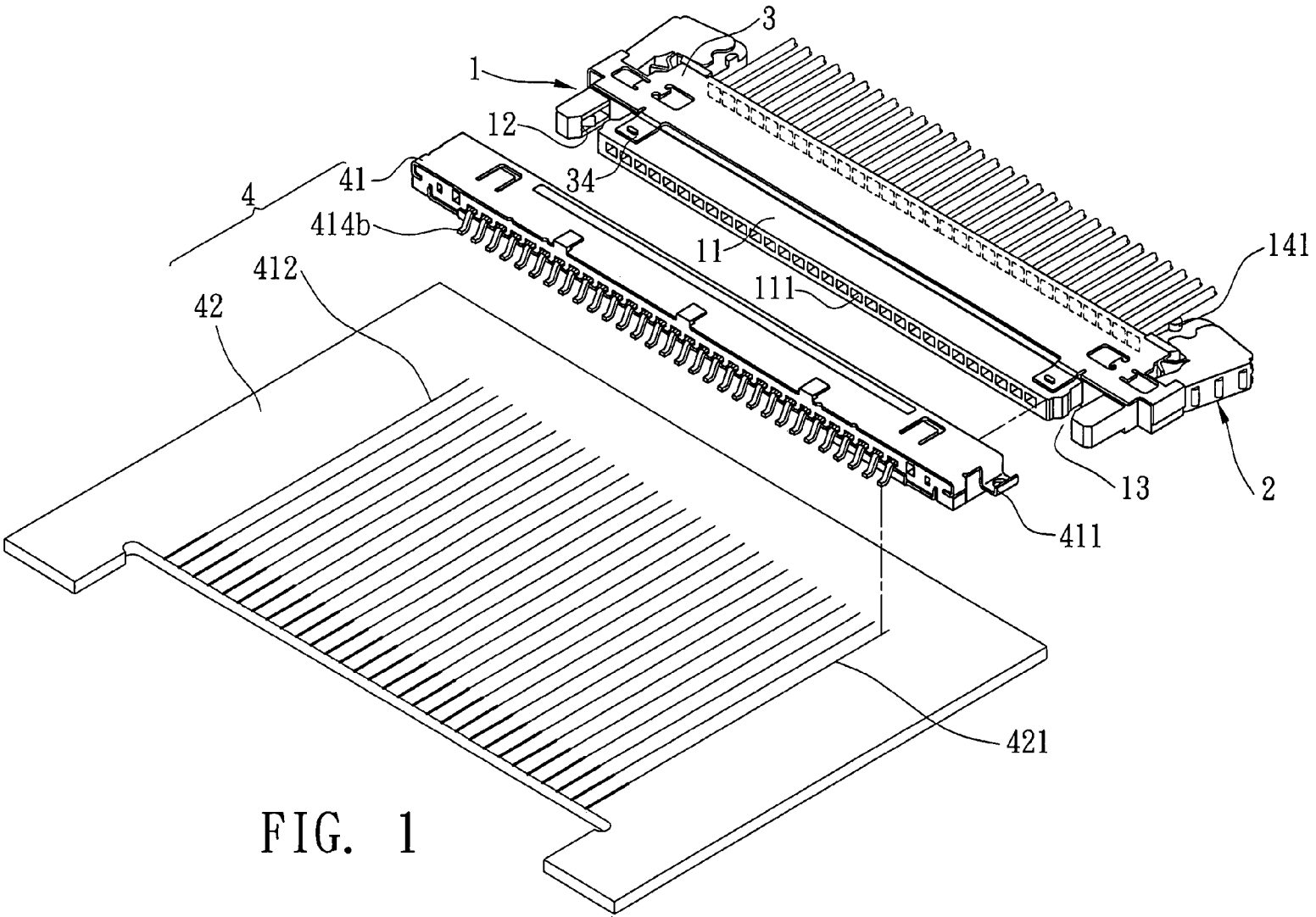
FIG. 1 shows a three-dimensional perspective view of the invention.

As shown in FIG. 1, an embodiment of connector structure is comprised of:

a male unit 1, the frontal end of said male unit 1 includes an inserting portion 11, the inserting portion 11 has a plurality of troughs 111 that are evenly distanced from one another, the top surface of the inserting portion 11 near the two lateral sides also has a concave portion 112 respectively, a fitting trough 12 is formed at both lateral sides of the frontal end in said male unit 1, and a clip-on space 13 is formed between said fitting trough 12 and inserting portion 11, there is also a protruding portion 14 located at both lateral sides of the rear end of said male unit 1, a stopper pin 141 is disposed upon the top and the bottom surfaces of said protruding portion 14, the surface between each of said clip-on space 13 and each of protruding portion 14 at both sides of said male unit 1 also has a pivot-joint opening 15 and a fastening opening 16, respectively, the pivot-joint opening 15 is interconnected to said fitting trough 12.

Two clip-on hooks 2, the two clip-on hooks 2 are structurally symmetrical, the frontal section of said clip-on hook 2 is formed into a hook portion 21, the middle section of said clip-on hook 2 has a through hole 22 that leads to the pivot-joint opening 15 described above, the rear section of said clip-on hook 2 is bent into an elastic portion 23 that includes an arc section 231, the said elastic portion 23 also includes a folded section 232 and a supporting section 233 that bends downwards, there is a space 234 existing between said folded section 232 and supporting section 233, the folded section being 232 is located at the bottom of said supporting section 233, a pressing portion 24 is also formed on the other side of said elastic portion 23 for pressing, and at least one anti-slip dot 241 is formed on the external surface of said pressing portion 24.

The frontal section of said clip-on hook 2 is fitted into said fitting trough 12 of male unit 1, and its through hole 22 is fitted around a pivot 31 of a metal partition 3, so that said hook portion 21 can protrude outwards from clip-on space 13. The elastic portion 23 covers the external surface of said protruding portion 14 of male unit 1, and the arc section 231 of said elastic portion 23 is pushed against said stopper pin 141 when pressed, while said supporting section 233 supports a lateral wall beneath said protruding portion 14.

Figure 2:
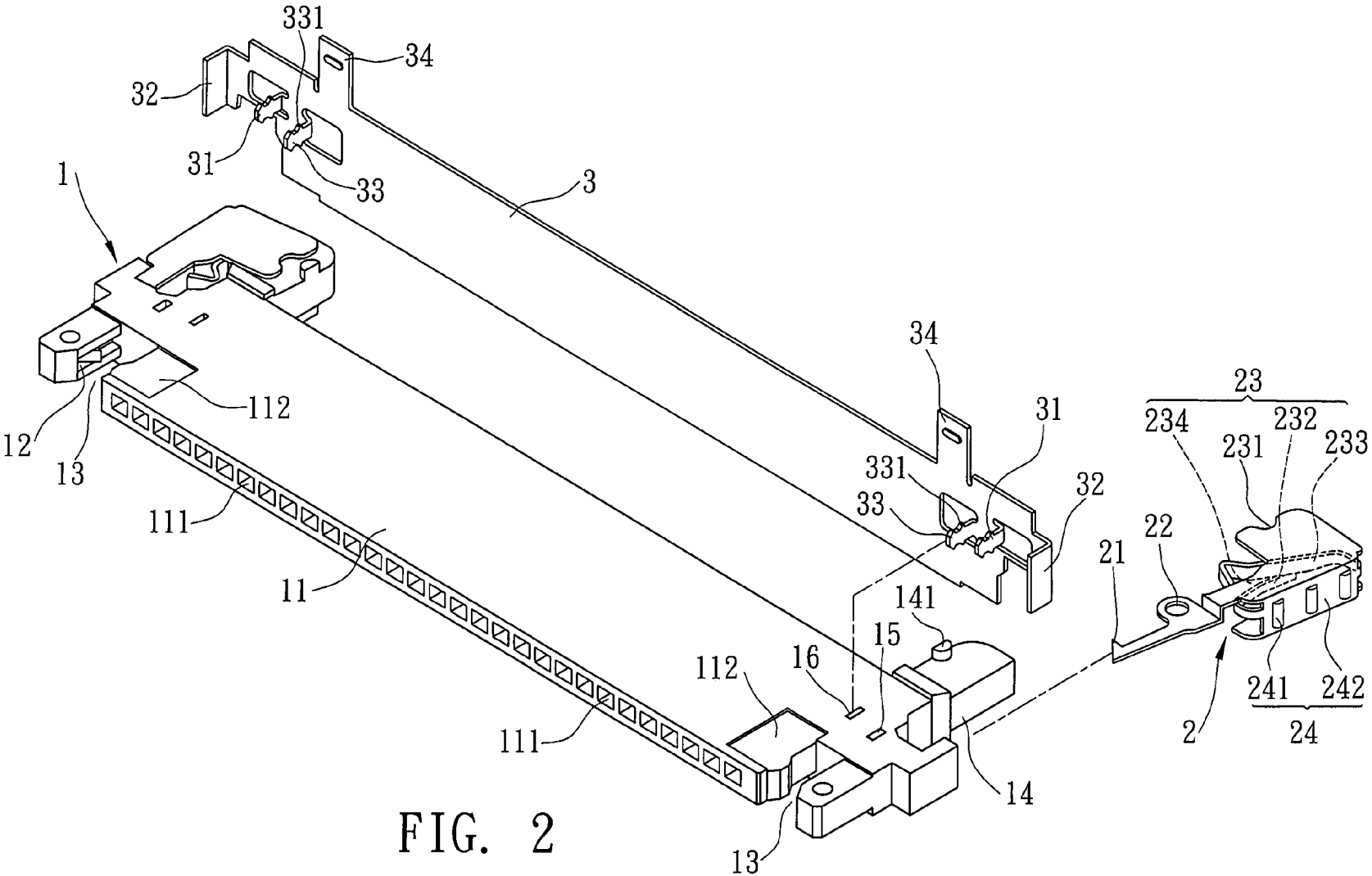
FIG. 2 is a perspective view showing the male unit, clip-on hook, and metal partition of the invention.
Figure 3:
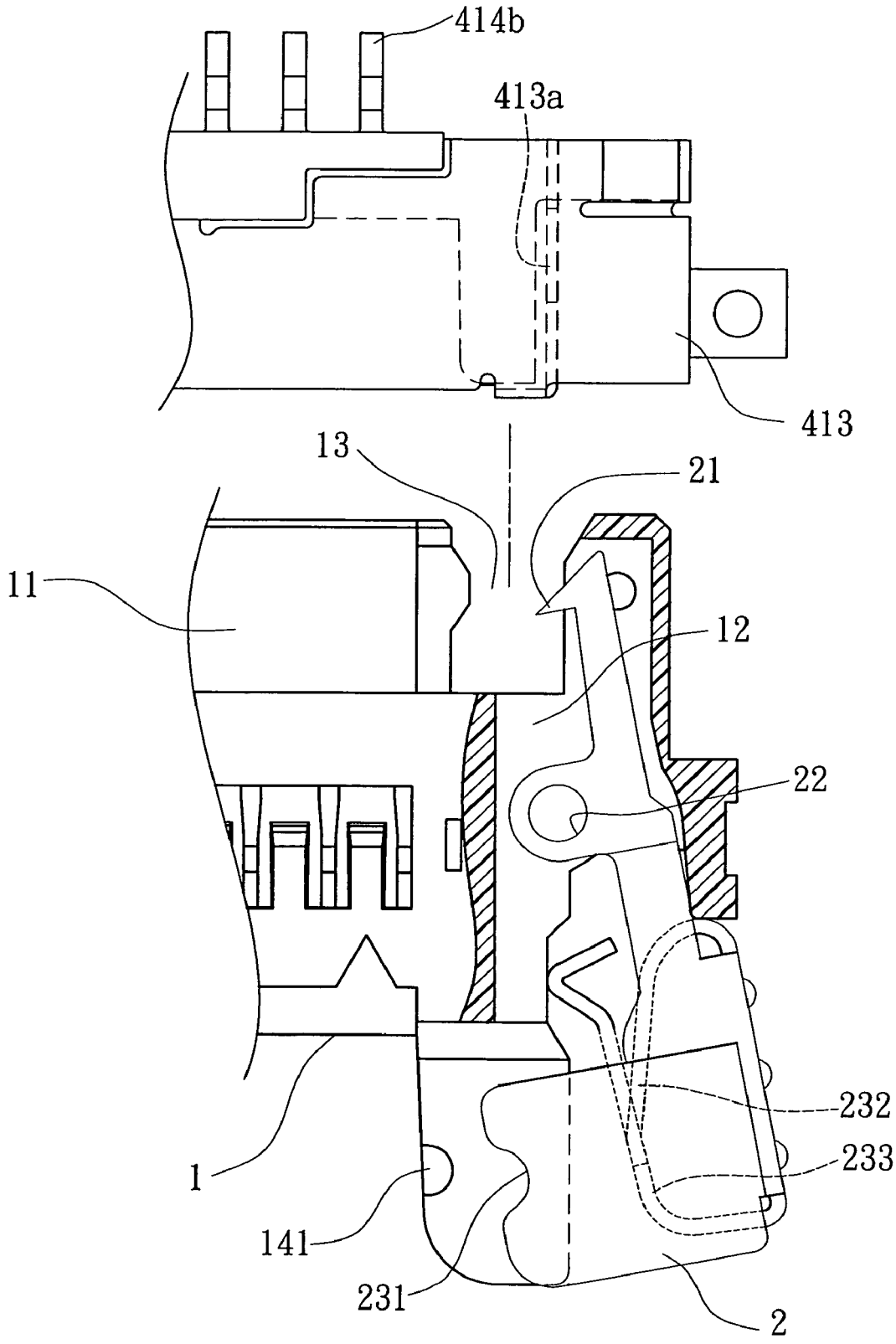
FIG. 3 is the first partial schematic view showing the male unit and the female unit of the invention.
Figure 4:
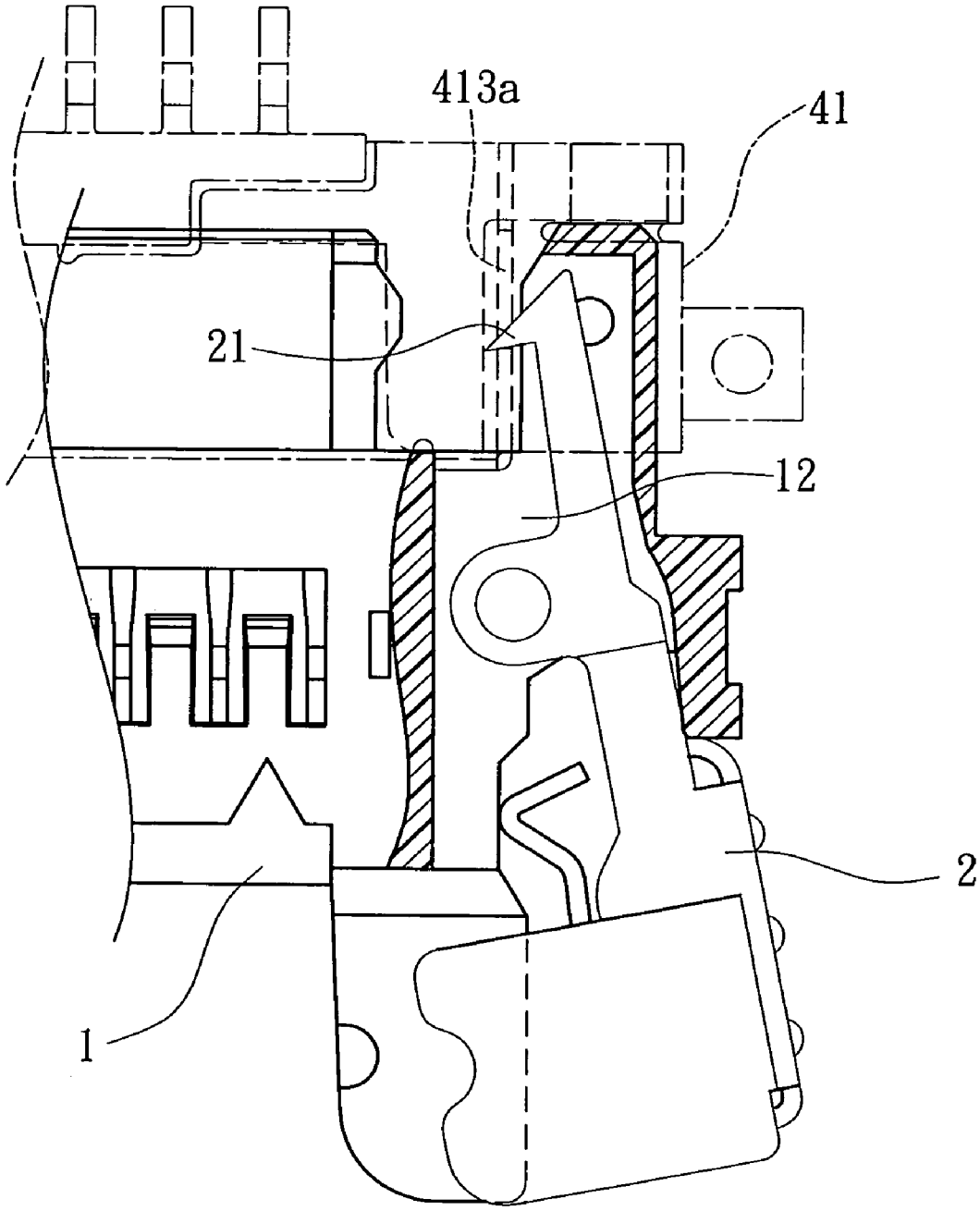
FIG. 4 is the second partial schematic view showing the male unit and the female unit of the invention.

The metal partition 3 covers the top surface of said male unit 1, with both ends having a lateral board 32. Each of said lateral board 32 holds to the surface of both ends of said male unit 1, the surface near each of said lateral board 32 is disposed with a pivot 31 and a fastening pin 33, wherein said fastening pin 33 fits into said fastening opening 16, said fastening pin 33 has protruding clip-on sections 331 at both sides, the pivot 31 fits through the pivot-joint opening 15 of said male unit 1 and the through hole 22 of said clip-on hook 2, and is fitted into said pivot-joint opening 15. An holding board 34 is disposed on the surface of the frontal end of said metal partition 3 where it corresponds to each concave portion 112, so that the holding board holds to the top surface of each of said concave portion 112, as indicated in FIGS. 2 to 4.

Figure 5:
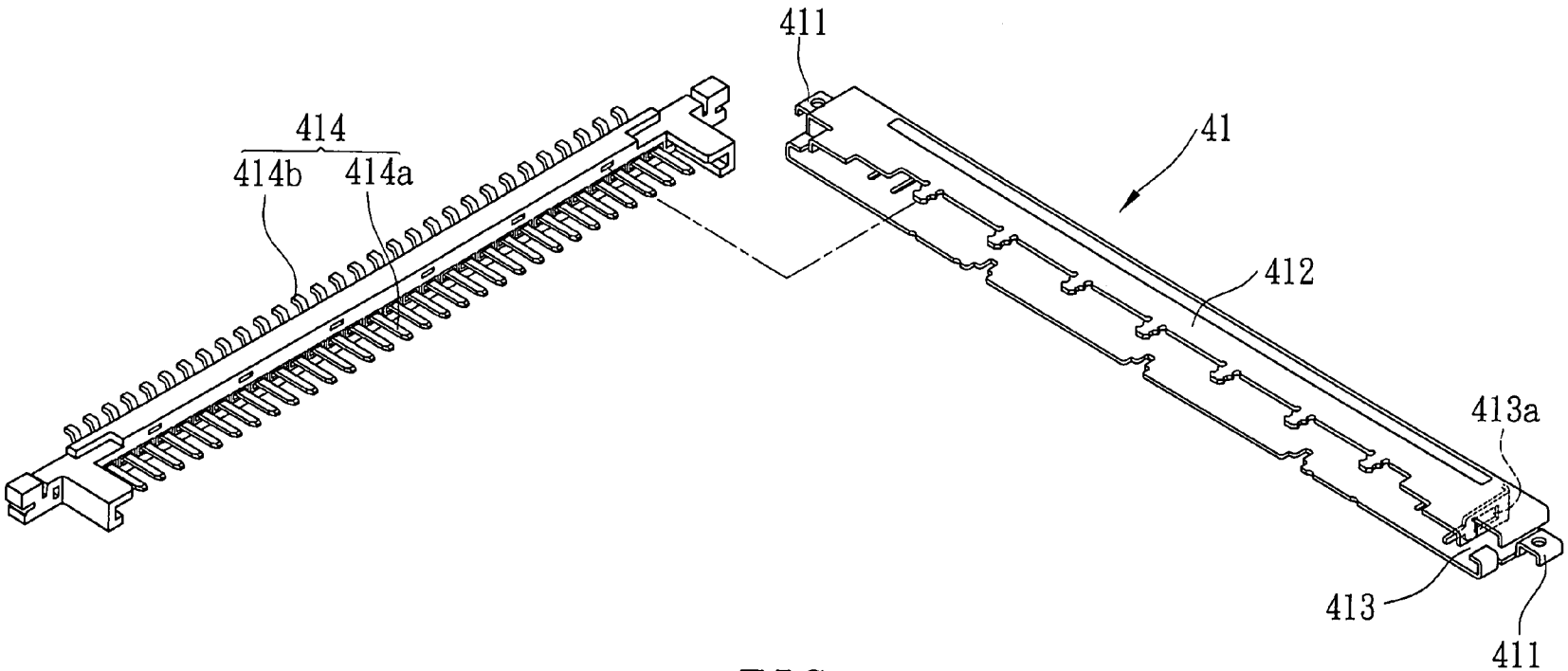
FIG. 5 shows a perspective view of the female unit of the invention.

In this embodiment, a connecting component 4 is interconnected to said inserting portion 11; the connecting component 4 includes a female unit 41 and a circuit board 42, a metal board 412 with pins 411 at both ends surrounding the perimeter of said female unit 41, and the two ends of said female unit 41 and metal board 412 are disposed with clip-on portions 413 that allow each said fitting trough 12 to clip onto, the inner wall of each said clip-on portion 413 includes a clip-on opening 413*a* that allows said hook portion 21 of each clip-on hook 2 to clip on and fasten. The section between the two clip-on portions 413 of said female unit 41 has a plurality of terminals 414, each terminal 414 is evenly distanced from the metal board 412. Each said terminal 414 includes primary terminals 414*a* and they connect into each said trough 111 independent of each other, while it also includes secondary terminals 414*b* that faces away from said troughs 111, and each secondary terminal 414*b* electrically connects to the circuits 421 on said circuit board 42 individually. In this embodiment, the secondary terminals 414*b* of said terminal 414 are formed as the shape of the letter J, as indicated in FIG. 5.

Figure 6:
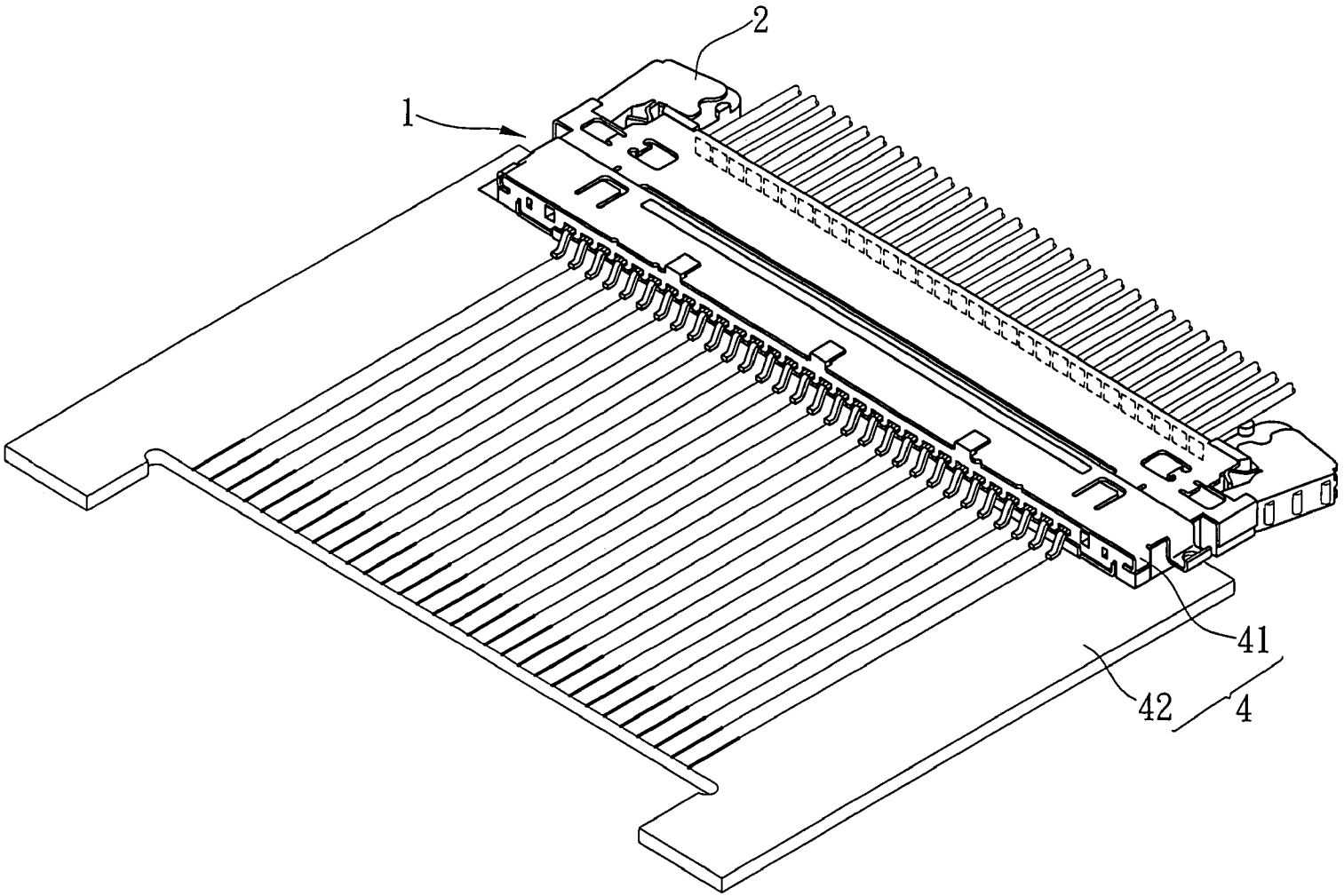
FIG. 6 is a schematic view showing the invention in actual usage.
Figure 7:
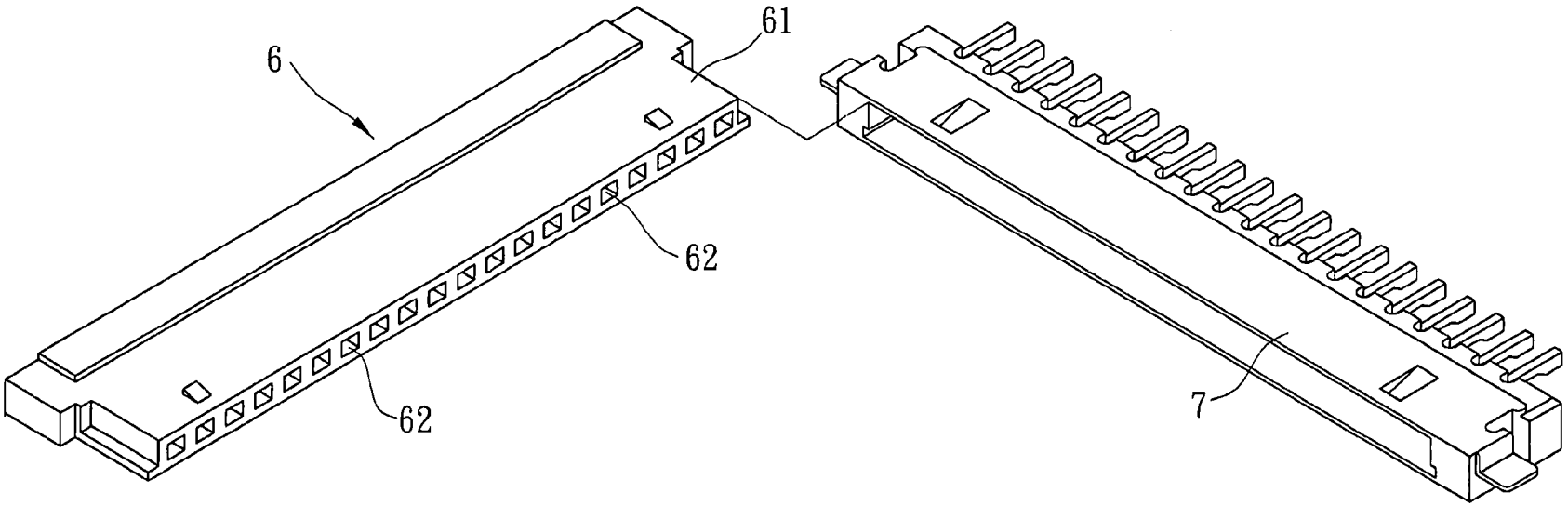
FIG. 7 PRIOR ART
FIG. 7 is a structural view showing the connector according to the prior art.

The actual usage and effects of the invention can be observed in FIG. 6; it should be noted that the secondary terminal 414*b* of terminal 414 in said female unit 41 is electrically connected to said circuits 421 of circuit board 42, hence when a user is about to connect the primary terminal 414*a* of said terminal 414 in female unit 41 to said male unit 1, one can press the pressing portion 24 of said clip-on hook 2, then clip-on hook 2 can exercise pivotal rotation by employing said pivot 31 of metal partition 3, which is fitted and surrounded by through hole 22, as a pivotal point, so that said supporting section 233 of elastic portion 23 is pushed against protruding portion 14, and then said arc section 231 of elastic portion 23 is blocked by said stopper pin 141, thereby making the space 234 between said supporting portion 233 and folded section 232 to disappear. On the other hand, because said elastic portion 23 is elastic and so can return to its original position when released, and said hook portion 21 of clip-on hook 2 is pushed into said fitting trough 12 of male unit 1, said male unit 1 can be successfully inserted into said female unit 41. Once said female unit 41 is inserted, the pressing portion 24 of clip-on hook 2 can be released, and then clip-on hook 2 returns to its former shape by the flexing action of its elastic portion 23, as a result, said hook portion 21 of clip-on hook 2 returns into clip-on space 13 and clips into said clip-on opening 413*a* of female unit 41, thereby completing the insertion of said female unit 41 and male unit 1, and allowing said male unit 1, female unit 41, and circuit board 42 to be connected together. The invention described above is intended to solve once and for all, the problem of loose or interrupted connections resulting from any slight pulls.

Moreover, because the connector structure has been miniaturized, great care should be taken when assembling clip-on hook 2. In this invention, the external surface of said pressing portion 24 in clip-on hook 2 have been disposed with anti-slip dots 241, thereby forming an anti-slip surface 242 that appears bumpy. Such surface can increase frictional force between hands and pressing portion 24 when a user presses on clip-on hook 2, thus preventing the connector slips out of a user's hands.

Furthermore, there is a clip-on opening 413*a* disposed on the inner wall of each of said clip-on portion 413, and this allows each of said hook portion 21 of clip-on hook 2 to clip into each of said clip-on opening 413*a* and become fastened, thereby making the connection between said male unit 1 and female unit 41 become even stronger.

What is claimed is:

1. A connector structure comprising:

a male unit, a frontal end of said male unit including an inserting portion having a respective concave portion located adjacent each of two sides of a top surface of said inserting portion, said inserting portion having a plurality of troughs that are evenly distanced one from another, a fitting trough being formed at each of two lateral sides of the frontal end in said male unit, a clip-on space being formed between said fitting trough and said inserting portion, a surface located between said clip-on space and a protruding portion at both sides of said male unit including a pivot-joint opening and a fastening opening, respectively, said pivot-joint opening being interconnected to said fitting trough;

two clip-on hooks, the two clip-on hooks being structurally symmetrical, wherein a frontal section of each said clip-on hook forms a hook portion, a middle section of each said clip-on hook includes a through hole that leads to said pivot-joint opening, a rear section of each said clip-on hook being bent into an elastic portion, an opposite side of said elastic portion being disposed with a pressing portion for pressing;

a metal partition covering a top surface of said male unit, wherein said metal partition has two ends having a respective lateral board, each lateral board holds to a corresponding surface of a respective end of said male unit, said metal partition having a pivot pin and a fastening pin disposed adjacent each of said lateral boards, wherein each said fastening pin is designed to fit into a corresponding one of said fastening openings, and each said pivot fits through a respective one of said pivot-joint openings of said male unit and the through hole of a corresponding one of said clip-on hooks, and is placed into a respective one of said pivot-joint openings;

a connecting component being interconnected to said inserting portion, the connecting component including a female unit and a circuit board, a metal board with pins at two ends thereof surrounds a perimeter of said female unit, and said female unit having clip-on portions respectively formed on two ends thereof that allow each fitting trough to clip thereon, an inner wall of each said clip-on portion including a clip-on opening that allows the hook portion of a corresponding clip-on hook to clip and be fastened thereto, a section disposed between the two clip-on portions of said female unit having a plurality of terminals, each terminal being evenly distanced from the metal board that surrounds the perimeter of said female unit, each terminal includes a primary terminal, each of said primary terminals connecting into a respective one of said plurality of troughs, and each said terminal also including a secondary terminal facing away from said troughs, each said secondary terminal electrically connects to a respective circuit on said circuit board.

2. The connector structure of claim 1, wherein said male unit includes a protruding portion respectively formed adjacent each of two sides of a rear end thereof, each of said protruding portions having a stopper pin on a top surface and a bottom surface thereof.

3. The connector structure of claim 1, wherein said elastic portion includes an arc section, a folded section, and a supporting section that bends downwards, the folded section being located at a bottom of said supporting section, said folded section and supporting section having a space formed between them.

4. The connector structure of claim 1, wherein said fastening pin has protruding clip-on sections at two sides thereof for securing said fastening pin into said corresponding fastening opening.

5. The connector structure of claim 1, wherein a surface of a respective frontal end of said metal partition disposed in correspondence to each concave portion includes a holding board, each said holding board holds to a top surface of a corresponding concave portion.

6. The connector structure of claim 1, wherein a frontal end of said clip-on hook fits into the fitting trough of said male unit, and its through hole receives the pivot of said metal partition, allowing the hook portion to protrude outwards from a respective clip-on space.

7. The connector structure of claim 1, wherein an external surface of said pressing portion includes anti-slip dots.

8. The connector structure of claim 1, wherein the secondary terminal of each of said terminals is formed into a J-shape.

* * * * *